United States Patent [19]

Howard

[11] 4,026,309

[45] May 31, 1977

[54] CHIP STRUCTURE

[75] Inventor: Robert Howard, Windham, N.H.

[73] Assignee: Gamex Industries Inc., Hudson, N.H.

[22] Filed: May 12, 1976

[21] Appl. No.: 685,891

Related U.S. Application Data

[62] Division of Ser. No. 495,679, Aug. 8, 1974, Pat. No. 3,983,646.

[52] U.S. Cl. ..... 133/8 R; 194/4 G; 40/27.5

[51] Int. Cl.[2] ..... G07D 9/00

[58] Field of Search ..... 133/8 R; 194/4 C, 4 F, 194/4 R, 6, 8, 4 G, 100 A; 250/461, 221; 209/111.7, 111.5; 273/DIG. 24; 40/27.5

[56] References Cited

UNITED STATES PATENTS

| | | | |
|---|---|---|---|
| 2,526,512 | 10/1950 | Snell et al. | 194/4 G |
| 2,894,626 | 7/1959 | Mulders et al. | 209/111.7 R |
| 3,968,582 | 7/1976 | Jones | 40/27.5 |

*Primary Examiner*—Stanley H. Tolberg

*Attorney, Agent, or Firm*—Ostrolenk, Faber, Gerb & Soffen

[57] ABSTRACT

A chip counter for use in gaming applications and the like comprising a tray having a trough for receiving chips, which trough is provided with a slit at the bottom thereof. The chips are stacked in the trough and are each provided with a strip about their periphery which is adapted to be more reflective to illuminating light than the main body of the chip. Reading means scans the chips in the trough along the slit provided therefor and counts pulses representative of the passage across the more highly light emissive edge of the chip. The more highly light emissive portions of the edges of each chip are made narrower than the thickness of each chip to develop discrete pulses.

Counting of chips of different denominations is accomplished by providing light emissive strips which emit light of differing wavelengths when light activated. The reader employs filters for passing predetermined light wavelength ranges to develop pulses representative of the proper wavelengths of light to make denominational decisions.

2 Claims, 11 Drawing Figures

FIG. 1.
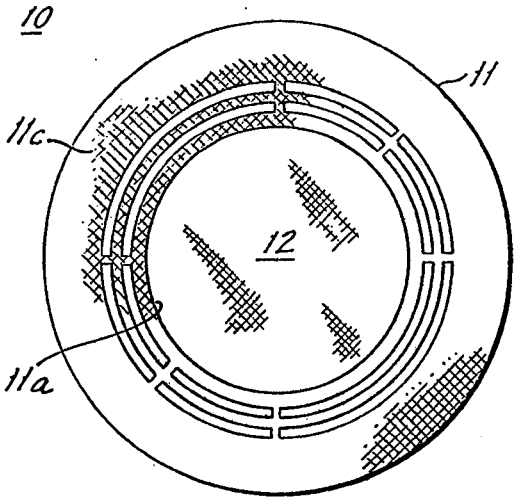
FIG. 1c.
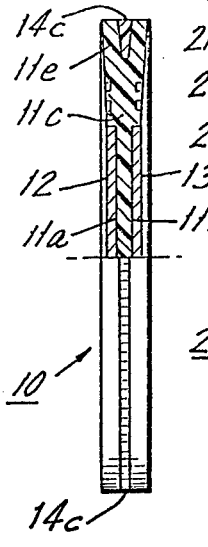
FIG. 3b.
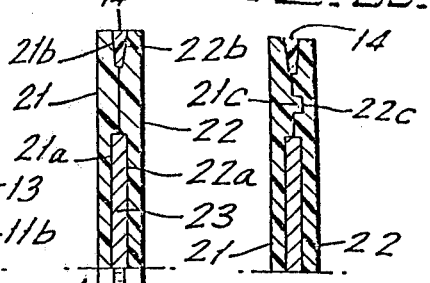
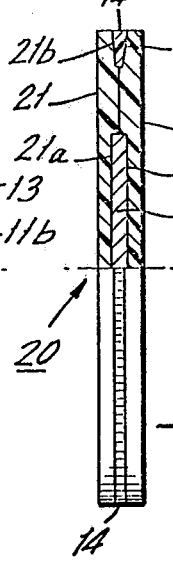
FIG. 3a.
FIG. 2a.
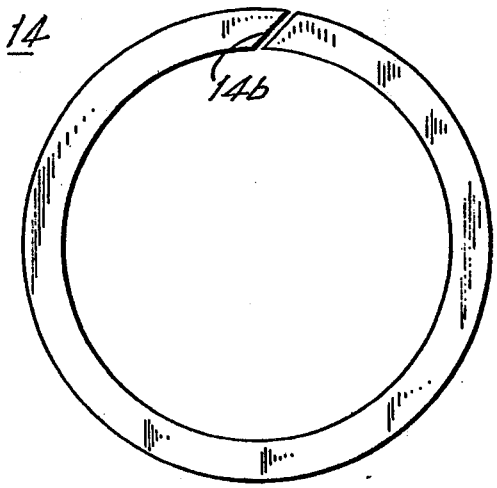
FIG. 2b.
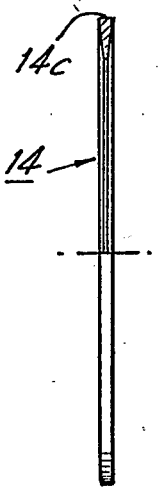
FIG. 2c.
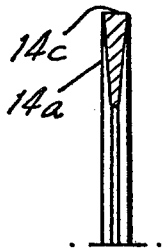
FIG. 4a.
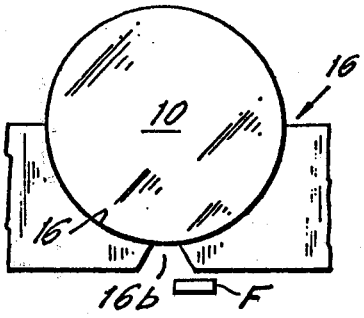
FIG. 1b.
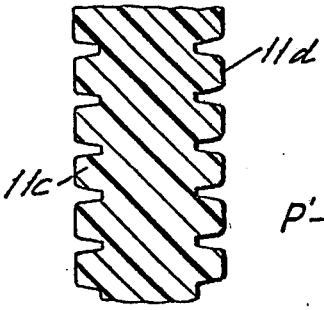
FIG. 4b.
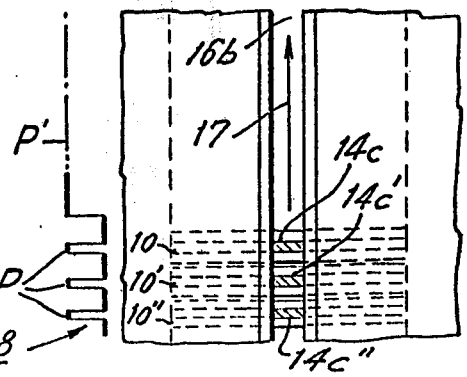
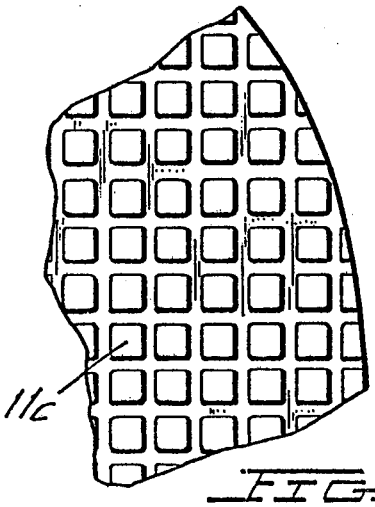
FIG. 1a.
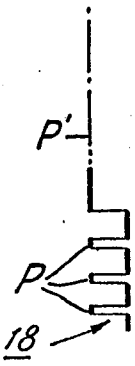

CHIP STRUCTURE

This is a division of application Ser. No. 495,679, filed Aug. 8, 1974, now U.S. Pat. No. 3,983,646.

The present invention relates to disc-shaped members and more particularly to a novel chip for use in gaming applications and the like which is appropriately weighted to provide the chip with more "body" and which has a fluorescing ring to facilitate identification of the presence of the chip by automated counting equipment.

BACKGROUND OF THE INVENTION

Gaming chips are typically employed in gaming facilities such as casinos and the like as a substitute for legal tender. Typically, a participant in a game converts legal tender into chips of one or more denominations with the chips received being provided with appropriate indicia to identify the particular casino and the denomination which the chip represents.

The dollar volume of chips taken in by a gaming casino over a set period such as a particular hour or day is determined by counting the total number of chips of each denomination, which operation is presently done manually wherein the denomination of the chip is determined by visual observation of appropriate indicia provided on each chip.

BRIEF DESCRIPTION OF THE INVENTION

The present invention is characterized by providing a novel chip structure which is inexpensive to manufacture due to the low cost of the components utilized to produce the chip and due to the ease of assembly. In addition thereto the chip is provided with an annular ring set into the periphery of the chip to facilitate identification and counting of the chip through the use of high speed automatic apparatus. The chip, in one preferred embodiment, is formed of a lightweight, inexpensive plastic material which is capable of being produced through inexpensive molding operations while providing a high quality chip of relatively tight tolerances. In order to provide a chip having substantial body at least one metallic insert is provided. An annular ring is set into the periphery of the chip and is formed of a plastic material admixed with a fluorescing substance adapted to emit light of a particular wavelength when exposed to light of a broad wavelength so as to be capable of being readily and easily counted through high speed automated apparatus.

BRIEF DESCRIPTION OF THE FIGURES AND OBJECTS

It is therefore one object of the present invention to provide a novel weighted chip structure having indicia bearing means for facilitating counting of the chip to high speed automated equipment.

Another object of the present invention is to provide a novel chip structure formed of inexpensive materials and yet having substantial body as well as an annular ring capable of fluorescing at a particular wavelength when exposed to light of a broad wavelength to facilitate counting of the chip by speed automated equipment.

The above as well as other objects of the present invention will become apparent when reading the accompanying description and drawings in which:

FIG. 1 shows a top plan view of a chip designed in accordance with the principles of the present invention.

FIG. 1*a* shows an enlarged plan view of a portion of the chip of FIG. 1 to indicate the surface texture thereof.

FIG. 1*b* shows an enlarged view of a section of the chip of FIG. 1, further indicating the nature of the surface texture of the chip.

FIG. 1*c* shows a sectional view of the chip of FIG. 1 taken along one diameter of the chip.

FIG. 2*a* shows a plan view of the ring insert employed in the chip of FIG. 1*c*.

FIG. 2*b* shows a partially sectionalized view of the ring of FIG. 2*a*.

FIG. 2*c* shows an enlarged view of the sectionalized portion of FIG. 2*b* to further facilitate an understanding of the structure.

FIG. 3*a* shows an end view, partially sectionalized, of another preferred embodiment of the present invention.

FIG. 3*b* shows a sectional view of a portion of a chip structure slightly modified from that shown in FIG. 3*a*.

FIGS. 4*a* and 4*b* show elevational and bottom plan views respectively of apparatus for automatically counting the chips of FIGS. 1–3.

DETAILED DESCRIPTION OF THE INVENTION

FIGS. 1–1*c* show a chip structure 10 comprised of a relatively thin circular-shaped disc body 11 preferably molded or otherwise formed from an inexpensive lightweight plastic material such as, for example, ZCETAL No. PDX 4090 manufactured by the Liquid Nitrogen Processing Corp. Any other plastic materials exhibiting the characteristic of being inexpensive, lightweight and having a capability of being easily and inexpensively molded into a disc-shaped member of relatively tight tolerances may be employed. The member 11 is provided with first and second shallow circular recesses 11*a* and 11*b* each respectively receiving a circular-shaped metallic disc 12 and 13 secured within the recesses by means of a suitable adhesive.

The annular shaped surfaces 11*c* and 11*d* surrounding each recess have a waffle-like pattern whose surface texture is shown best in FIG. 1*a* in which a portion of the surface is shown greatly enlarged. FIG. 1*b* shows a greatly enlarged cross-sectional view taken through the annular portion. The surface texture improves the aesthetic appearance of the chip as well as providing a surface which facilitates handling of the chip. The exterior surfaces of the metallic discs 12 and 13 have a brushed or matte like finish.

The periphery of the chip is provided with an inwardly tapering continuous groove 11*e* adapted to receive a ring insert 14 shown best in FIGS. 2*a*–2*c* and having a tapered cross-sectional configuration shown at 14*a* in FIG. 2*c*. Ring 14 is molded of a suitable plastic material such as, for example, Lexan which is homogeneously admixed with a pigment having the characteristic of emitting light of a predetermined wavelength when excited by a broad wavelength light source. Ring 14 is severed as shown in 14*b* to facilitate insertion of the ring into tapered groove 11*e* so as to provide a substantially continuous outer surface portion 14*c* which is substantially flush with the periphery of chip member 11.

The manner in which the chips may be automatically counted is shown best in FIGS. 4*a* and 4*b* wherein the chip tray 16 is shown as being provided with an arcuate shaped trough 16*a* for receiving a plurality of chips. The underside of the trough is provided with an opening 16*b* so as to expose a small arcuate portion of the periphery of each chip stacked within the trough. FIG. 4*b* shows a view of the underside of the chip tray. Three chips 10, 10' and 10'' are shown stacked in the trough and having portions of the outer surfaces 14*c*, 14*c'* and 14*c''* exposed through opening 16*b*. One preferred technique for counting chips is to provide a suitable light source such as, for example, a black light which emit rays to excite the fluorescing pigments contained in the rings 14. These pigments emit light of a predetermined wavelength which is detected, for example, by a scanning device such as, for example, a TV camera adapted to scan the length of the elongated opening 16*b* in the direction shown by arrow 17 for the purpose of generating a signal such as waveform 18 shown in FIG. 4*b*. A light filter F is positioned between the scanning device and elongated opening 16*b* and is adapted to pass light lying witin a narrow bandwidth, which bandwidth includes that wavelength of light emitted by the fluorescing material in ring 14. As the scanner scans across surfaces 14*c''*, 14*c'* and 14*c*, pulses P are generated indicating the presence of a chip. Since the ambient light passing through slit 16*b* in the region devoid of chips may contain the constituent wavelength, an output signal as shown by continuous elongated pulse P' will be generated. However, this is clearly distinguishable from the individual pulses P arranged in spaced fashion to thereby assure accurate counting of the number of chips in the trough. The chip tray 16 may be provided with a plurality of preferably spaced parallel troughs to accommodate a large quantity of chips.

Chips of different denominations may be provided with bodies 11 of different colors and/or printed indicia may be provided on one or both surfaces of the chips. In addition thereto the pigments admixed with the ring 14 may be adapted to fluoresce at different predetermined wavelengths to provide means for automatically detecting the presence of chips of different denominations. In order to automatically count chips of different denominations, the filter F may be replaced by an indexable filter wheel provided with a quantity of filters equal in number to the total number of chip denominations. During each scan a different filter is indexed or otherwise move so as to be positioned in front of the scanner so that only light of a predetermined wavelength will be passed. Upon the completion of each scan the filter wheel is indexed to position a filter which passes a different wavelength denomination and associated with a particular chip in front of the scanner. Thus, chips of different denominations may be indiscriminately stacked within trough 16*a* in any arrangement without affecting the accuracy of the count.

As another alternative, chips of different denominations may be stacked in different troughs allocated for each chip denomination. The chips may, for example, be color coded. When the scanner steps from one trough to the next the chip count for each trough is transferred to a separate counter thereby providing an accurate count of the number of chips in each trough and, with knowledge of the denomination allocated to that trough, also provide a count of the total volume of chips.

The use of metallic inserts 12 and 13 yields a chip of substantial body and cooperates with the surface texturing to facilitate handling of the chips.

FIG. 3*a* shows another preferred embodiment 20 of the present invention which is comprised of disc halves 21 and 22 each having a shallow recess 21*a* and 22*a* for receiving a single metallic insert 23. Halves 21 and 22 and metallic insert 23 are joined along their engaging surfaces by means of a suitable epoxy. Disc-shaped halves 21 and 22 are provided with continuous annular bevelled surfaces 21*b* and 22*b* which, when halves 21 and 22 are joined in the manner shown in FIG. 3*a*, collectively form an annular tapered groove for receiving insert ring 14. The embodiment 20 simplifies the insertion of ring 14 by eliminating the need for providing slit 14*b* (see FIG. 2*a*) since a ring may be placed between the two disc halves and glued into position substantially at the same time that the disc halves are joined to one another. Thus, the disc may be weighted appropriately while totally concealing the insert 23. This arrangement also eliminates the need for finishing insert 23 as well as reducing the number of inserts required. The nature and properties of the ring 14 are the same as those described in connection with the embodiment 10.

The plastic chip halves 21 and 22 may be provided with cooperating interfitting portions to enhance the joinder of the two members. For example, as shown in FIG. 3*b*, the interior surface of disc half 21 may be provided with a projection 21*c* which is adapted to fit within a groove 22*c* provided along the inner surface of disc half 22 and adapted to force fittingly receive projection 21*c*. The interfitted portions may consist of a series of cooperating pins and holes or may, for example, be a continuous annular projection adapted to be inner-fitted into a co-aligned continuous annular groove.

It can be seen from the foregoing description that the present invention provides a novel chip assembly for use in gaming applications and the like in which a chip is formed of relatively inexpensive materials which may be readily and simply assembled to provide a chip having substantial body and to provide means or indicia to facilitate automatic high speed counting of chips through the employment of a ring of fluorescing material.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. Means for counting chips having fluorescent stripes along their periphery and adapted to emit light of a predetermined wavelength when excited comprising:

a trough for supporting chips;

said trough having an elongated slot;

means for directing light towards said slot to excite said stripes;

means for scanning along said slot;

filter means positioned between said slot and said scanning means to pass light of only said predetermined wavelength;

said scanning means including means for generating a pulse for each scanned stripe;

means for counting said pulses to provide a count of said chips.

2. The means of claim 1 wherein chips of different denominations have stripes adapted to fluoresce light of different wavelengths;

said filter means comprising plural filters each adapted to pass light of each different wavelength and means for positioning each filter between said scanning means and said slot, whereby said scanning means scans said slot once for each filter positioned between said slot and said scanning means whereby the pulses generated during each scan represents a count of the chips of each different denomination.

* * * * *